US010995417B2

(12) United States Patent
Commander et al.

(10) Patent No.: US 10,995,417 B2
(45) Date of Patent: May 4, 2021

(54) COBALT FILLING OF INTERCONNECTS IN MICROELECTRONICS

(71) Applicant: MacDermid Enthone Inc., Waterbury, CT (US)

(72) Inventors: John Commander, Old Saybrook, CT (US); Vincent Paneccasio, Jr., Madison, CT (US); Eric Rouya, Oakland, CA (US); Kyle Whitten, Hamden, CT (US); Shaopeng Sun, Orange, CT (US); Jianwen Han, Waterbury, CT (US)

(73) Assignee: MacDermid Enthone Inc., Waterbury, CT (US)

( * ) Notice: Subject to any disclaimer, the term of this patent is extended or adjusted under 35 U.S.C. 154(b) by 114 days.

(21) Appl. No.: 15/739,314

(22) PCT Filed: Jun. 30, 2016

(86) PCT No.: PCT/US2016/040501

§ 371 (c)(1),
(2) Date: Dec. 22, 2017

(87) PCT Pub. No.: WO2017/004424

PCT Pub. Date: Jan. 5, 2017

(65) Prior Publication Data

US 2020/0040478 A1 Feb. 6, 2020

Related U.S. Application Data

(60) Provisional application No. 62/186,978, filed on Jun. 30, 2015.

(51) Int. Cl.

*C25D 3/16* (2006.01)
*C25D 7/12* (2006.01)
(Continued)

(52) U.S. Cl.

CPC ..... *C25D 7/12* (2013.01); *C25D 3/16* (2013.01); *C25D 3/562* (2013.01); *C25D 5/18* (2013.01)

(58) Field of Classification Search

None
See application file for complete search history.

(56) References Cited

U.S. PATENT DOCUMENTS 3,969,399 A * 7/1976 Passal ..... C25D 3/12 562/101
4,069,112 A * 1/1978 Harbulak ..... C25D 3/14 205/260

(Continued)

FOREIGN PATENT DOCUMENTS

DE 2642666 3/1977
DE 19949549 4/2001

(Continued)

*Primary Examiner* — Stefanie S Wittenberg
(74) *Attorney, Agent, or Firm* — Carmody Torrance Sandak & Hennessey LLP

(57) ABSTRACT

Processes and compositions for electroplating a cobalt deposit onto a semiconductor base structure comprising submicron-sized electrical interconnect features. In the process, a metalizing substrate within the interconnect features is contacted with an electrodeposition composition comprising a source of cobalt ions, an accelerator comprising an organic sulfur compound, an acetylenic suppressor, a buffering agent and water. Electrical current is supplied to the electrolytic composition to deposit cobalt onto the base structure and fill the submicron-sized features with cobalt. The process is effective for superfilling the interconnect features.

20 Claims, 1 Drawing Sheet

(51) Int. Cl.
*C25D 3/56* (2006.01)
*C25D 5/18* (2006.01)

(56) References Cited

U.S. PATENT DOCUMENTS

| | | | | |
|---|---|---|---|---|
| 5,221,458 | A | 6/1993 | Herbert et al. | |
| 9,574,280 | B2 | 2/2017 | Ishikawa et al. | |
| 2005/0173254 | A1 | 8/2005 | Bokisa et al. | |
| 2005/0230262 | A1 | 10/2005 | Chen | |
| 2006/0213780 | A1 | 9/2006 | Shih et al. | |
| 2008/0202922 | A1 | 8/2008 | Zhong et al. | |
| 2009/0035940 | A1 | 2/2009 | Richardson et al. | |
| 2009/0188805 | A1 | 7/2009 | Moffat et al. | |
| 2010/0304172 | A1 | 12/2010 | Facchini et al. | |
| 2011/0163449 | A1* | 7/2011 | Kelly | H01L 23/485 257/750 |
| 2012/0018310 | A1 | 1/2012 | Roeger-Goepfert et al. | |
| 2015/0345039 | A1* | 12/2015 | Josell | C25D 5/04 205/96 |
| 2016/0273117 | A1* | 9/2016 | Doubina | C25D 17/001 |
| 2019/0226107 | A1 | 7/2019 | Kienle et al. | |

FOREIGN PATENT DOCUMENTS

| | | |
|---|---|---|
| KR | 1020140092855 | 7/2014 |
| WO | 2018015168 | 1/2018 |

* cited by examiner

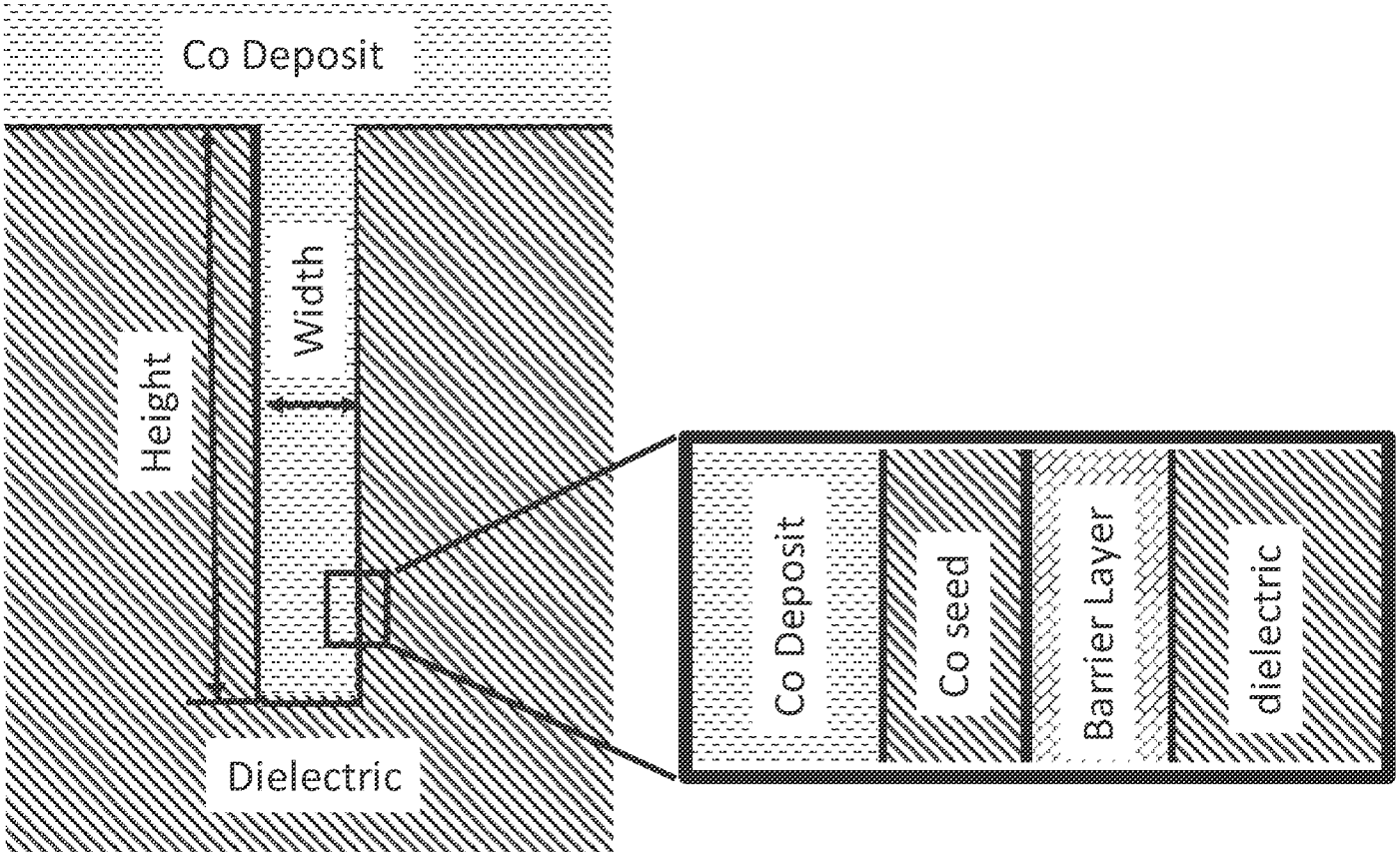
Co Deposit
Height
Width
Dielectric
Co Deposit
Co seed
Barrier Layer
dielectric

COBALT FILLING OF INTERCONNECTS IN MICROELECTRONICS

FIELD OF THE INVENTION

The compositions and processes described herein generally relate to electrolytic deposition chemistry and a method for depositing cobalt and cobalt alloys; and more specifically to additives and overall compositions for use in an electrolytic plating solution and a method for cobalt-based metallization of interconnect features in semiconductor substrates.

BACKGROUND OF THE INVENTION

In damascene processing, electrical interconnects are formed in an integrated circuit substrate by metal-filling of interconnect features such as vias and trenches formed in the substrate. Copper is a preferred conductor for electronic circuits. But when copper is deposited on a silicon substrate, it can diffuse rapidly into both the substrate and dielectric films such as $SiO_2$ or low k dielectrics. Copper also has a tendency to migrate from one location to another when electrical current passes through interconnect features in service, creating voids and hillocks. Copper can also diffuse into a device layer built on top of a substrate in multilayer device applications. Such diffusion can be detrimental to the device because it can damage an adjacent interconnect line and/or cause electrical leakage between two interconnects resulting in an electrical short. And the corresponding diffusion out of the interconnect feature can disrupt electrical flow.

In recent years, along with the reduction in size and desired increase in the performance of electronic devices, the demand for defect free and low resistivity interconnects in the electronic packaging industry has become critical. As the density of an integrated circuit within a microelectronic device continues to increase with each generation or node, interconnects become smaller and their aspect ratios generally increase. The build-up process such as barrier and seed layers, prior to damascene copper electroplating, now suffers from disadvantages that are becoming more pronounced as the demand for higher aspect ratio features and quality electronic devices increases. As a result there is an increase in demand for a more suitable plating chemistry to enable defect free metallization.

Where submicron vias and trenches are filled by electrolytic deposition of copper, it is generally necessary to first deposit a barrier layer on the walls of the cavity to prevent the diffusion and electromigration of copper into the surrounding silicon or dielectric structure. In order to establish a cathode for the electrodeposition, a seed layer is deposited over the barrier layer. The thickness of barrier and seed layers can be very small, especially where the electroplating solution contains a proper formulation of accelerators, suppressors, and levelers. However, as the density of electronic circuitry continues to increase, and the entry dimensions of vias and trenches become ever smaller, even the very thin barrier and seed layers progressively occupy higher and higher fractions of the entry dimensions. As the entry apertures reach dimensions below 50 nm, and especially as they are further reduced to less than 40 nm, 30 nm, 20 nm or even less than 10 nm, such as about 8 or 9 nm, it becomes increasingly difficult to fill the cavity with a copper deposit that is entirely free of voids and seams. The most advanced features under current development have bottom widths of only 2-3 nm, a middle width of about, 4 nm, and a depth of 100 to 150 nm, translating to an aspect ratio of between about 25:1 and about 50:1.

Electrolytic deposition of Co is performed in a variety of applications in the manufacture of microelectronic devices. For example, Co is used in capping of damascene Cu metallization employed to form electrical interconnects in integrated circuit substrates. However, because of a higher resistivity of cobalt deposits, such processes have not previously offered a satisfactory alternative to electrodeposition of copper in filling vias or trenches to provide the primary interconnect structures.

SUMMARY OF THE INVENTION

Described herein are compositions for the electrolytic deposition of cobalt comprising a source of cobalt ions; an accelerator compound; a suppressor compound; a buffering agent; and water.

Such compositions are used in a process for filling a submicron cavity in a dielectric material wherein the cavity has a wall region comprising a contact material, the process comprising contacting a dielectric material comprising the cavity with an electrolytic cobalt plating composition under conditions effective for reduction of cobalt ions and deposit of cobalt on the wall regions, wherein the cobalt plating composition comprises a source of cobalt ions; an accelerator comprising an organic sulfur compound; an acetylenic suppressor compound; a buffering agent; and water. Optionally, the composition may further include a compound that functions as a stress reducer.

Further described herein are alternative electrodeposition compositions for the electrodeposition of cobalt that are substantially free of divalent sulfur compounds, and preferably free of any compound that would function as an accelerator in superfilling of submicron features of a semiconductor integrated circuit device. These compositions comprise a source of cobalt ions, an acetylenic suppressor compound, a buffering agent and water.

Also described are methods for filling submicron features of a semiconductor integrated circuit device by electrodeposition from the aforesaid compositions.

BRIEF DESCRIPTION OF THE DRAWING

FIG. 1 is a schematic illustration of a cobalt filled feature prepared by the method of the invention.

DESCRIPTION OF THE PREFERRED EMBODIMENTS

Cobalt-based electrolytic plating compositions and methods have been developed for use in electrolytic deposition of cobalt as an alternative to copper in the manufacture of semiconductor integrated circuit devices. More particularly, the compositions and methods of the invention are effective for filling submicron features of such devices.

The cobalt-based plating compositions described herein contain a source of cobalt ions. Although various cobaltous salts can be used, $CoSO_4$ is highly preferred. This source of cobaltous ions is readily available, for example, as cobalt sulfate heptahydrate. The composition is formulated with a cobalt salt in a concentration which is sufficient to provide between about 1 and about 50 g/L of $Co^{2+}$ ions, such as between about 2 and about 10 g/L, or more preferably between about 5 and about 10 g/L.

The composition also preferably contains one or more sulfidic accelerator compounds. While various organic sulfur compounds can be used, bis(sodium sulfopropyl)disulfide ("SPS"), 3-mercaptosulfonic acid ("MPS"), 3-(N,N-Dimethylthiocarbamoyl)-1-propane sulfonic acid sodium salt ("DPS") and/or a thiourea-based compound are preferred. It has been found that a relatively strong accelerator provides for more effective superfilling of submicron cavities with cobalt. Thus, SPS and DPS are preferred accelerators, with SPS being particularly preferred. The concentration of the accelerator is preferably between about 0.5 and about 50 mg/L, such as between about 5 and about 25 mg/L.

The composition also contains one or more suppressor compounds which preferably comprise acetylenic alcohol compounds or derivatives thereof. A currently preferred suppressor is propargyl alcohol. Other currently preferred suppressor compounds include ethoxylated propargyl alcohols, the product of the reaction of ethoxylated propargyl alcohol and 1,4-butanediol diglycidyl ether; propargyl alcohol; diethylene glycol bis(2-propynyl) ether; 1,4-bis(2-hydroxyethoxy)-2-butyne; and 2-butyne-1,4-diol. The concentration of the suppressor is preferably between about 5 and about 250 mg/L, such as between about 10 and about 50 mg/L.

The cobalt electrodeposition composition also preferably comprises a buffer to stabilize the pH. A preferred buffer is boric acid. Boric acid ($H_3BO_3$) may be incorporated into the composition in a concentration between about 5 and about 50 g/L, such as between about 15 and about 40 g/L. The pH of the composition is preferably in the range of about 1.5 to about 7, such as from about 2.5 to about 5.

The electrodeposition composition is preferably free of nickel ions and iron ions. If either nickel ions or iron ions are present, the molar ratio of both nickel ions and iron ions, and the sum of nickel ions and iron ions, to cobalt ions is preferably not greater than about 0.01, or between about 0.00001 and about 0.01.

The electrodeposition composition is also preferably substantially free of copper ions. Although very minor copper contamination may be difficult to avoid, it is particularly preferred that the copper ion content of the bath is no more than 20 ppb, e.g., in the range of 0.1 ppb to 20 ppb.

The composition preferably consists essentially of an aqueous solution that is devoid of any solid particulates or other solid phase component. Particulate solids in a concentration up to 0.001 vol. %, preferably no more than 0.00001 vol. %, might be present due to infiltration of solids from process equipment, conduits or material sources, but the composition should, if possible, be free of any functional concentration of particulates, and most preferably entirely free of any solid particulates that would be detectable by analytical apparatus or methods commonly used in industrial fabrication of electronics products.

The electrodeposition composition is preferably free of any functional concentration of reducing agents effective to reduce cobaltous ion ($Co^{2+}$) to metallic cobalt)($Co^0$). By a functional concentration is meant any concentration of an agent that either is effective to reduce cobaltous ions in the absence of electrolytic current or is activated by an electrolytic current or electrolytic field to react with cobaltous ions.

The electrodeposition composition may be used in a process for filling submicron features of a semiconductor base structure, the features comprising cavities in the base structure that are superfilled by rapid bottom-up deposition of cobalt. A metalizing substrate comprising a seminal conductive layer is formed on the internal surfaces of the submicron features, e.g., by physical vapor deposition of metal seed layer, preferably a cobalt metal seed layer, or deposition of a thin conductive polymer layer, A submicron electrical interconnect feature has a bottom, sidewalls, and top opening. The metalizing substrate is applied to the bottom and sidewall, and typically to the field surrounding the feature. The metalizing substrate within the feature is contacted with the electrodeposition composition and current is supplied to the electrodeposition composition to cause electrodeposition of cobalt that fills the submicron features. By coaction of the accelerator and suppressor, a vertical polarization gradient is formed in the feature which causes it to be filled by bottom up deposition at a rate of growth in the vertical direction which is greater than a rate of growth in the horizontal direction, yielding a cobalt interconnect that is substantially free of voids and other defects.

To implement the electrodeposition process, an electrolytic circuit is formed comprising the metalizing substrate, an anode, the aqueous electrodeposition composition, and a power source having a positive terminal in electrically conductive communication with the anode and a negative terminal in electrically conductive communication with the metalizing substrate. Preferably, the metalizing substrate is immersed in the electrodeposition composition. An electrolytic current is delivered from the power source to the electrolytic composition in the circuit, thereby depositing cobalt on the metalizing substrate.

The electrodeposition process is preferably conducted at a bath temperature in the range of about 5° C. to about 80° C., more preferably between about 20° C. and about 50° C., and a current density in the range between about 0.01 and about 2 $A/dm^2$, preferably between about 0.05 and about 1 $A/dm^2$. Optionally, the current may be pulsed, which can provide some improvement in the uniformity of the deposit. On/off pulses and reverse pulses can be used. Pulse plating may enable relatively high current densities, e.g., >8 $mA/cm^2$ during cobalt deposition.

To reduce internal stresses in the cobalt deposit, the electrodeposition composition preferably includes a stress reducer such as saccharin. Preferably, saccharin is present in the electrodeposition composition in a concentration between about 10 and about 300 ppm, more preferably between about 100 and about 200 ppm. In the absence of a stress reducer such as saccharin, internal tensile stresses in the cobalt deposit can range as high as 1000 MPa, typically between about 500 and about 800 Mpa. Where the plating composition contains saccharin, internal tensile stress in the cobalt deposit is no greater than 500 MPa, typically between 0 and about 500 MPa, more typically between 0 and about 400 MPa.

Preferably, the electrodeposition composition contains between about 0.1 and about 5 wt. % cobalt ions, between about 0.5 and about 50 mg/l accelerator; between about 5 and about 250 mg/l of an acetylenic suppressor compound; and between about 1 and about 4.5 wt. % buffer. The pH of the composition is preferably between about 1.5 and about 7, more preferably between about 2.5 and about 5.

More preferably, the electrodeposition composition contains between about 5 and about 10 g/l cobaltous ion, between about 5 and about 25 mg/l SPS, between about 5 and about 30 mg/l of a suppressor selected from the group consisting of propargyl alcohol and ethoxylated propargyl alcohol, the balance substantially water. The pH is preferably adjusted to a value between about 2.5 and about 3.5. Sulfuric acid is preferred for pH adjustment.

The novel compositions and processes are effective in the preparation of semiconductor integrated circuit devices comprising the semiconductor base structure and submicron interconnect features filled with cobalt. Providing cobalt interconnects is especially advantageous where the interconnects have a width or diameter less than 100 nm and an aspect ratio of greater than 3:1. The attractiveness of cobalt increases as the size of the interconnect cavity decreases to 50 nm, 30 nm or below having aspect ratios of greater than 3:1, such as between 4:1 and 10:1 or higher. For example the process may be implemented to produce a semiconductor integrated circuit device comprising a semiconductor base structure having a plurality of cavities therein wherein each cavity of such plurality of cavities has a width or diameter of not greater than 20 nm and is filled with cobalt by electrodeposition over a seminal conductive layer of a given thickness on the interior wall of the cavity. Cavities can be filled having entry dimensions (width or diameter) as small as 7 nm or even 4 nm and aspect ratios of greater than 15:1, greater than 20:1 or even greater than 30:1, for example, between 10:1 and 50:1, or between 15:1 and 50:1.

Because the use of cobalt allows a barrier layer to be dispensed with, the volume of cobalt with which a via or trench having a width or diameter of 20 nm or less may be filled substantially exceeds the volume of copper with which the same feature may be filled. For example, if the requisite thickness of the barrier layer under a copper deposit is 30 angstroms, the volume of cobalt (including, e.g., a 20 angstrom seed layer) with which a feature having a width or diameter of 20 nm or may be filled typically exceeds the volume of copper (also including a 20 angstrom seed layer) with which the same feature may be filled by at least 50%, more typically at least 100%. The relative difference increases as the size of the feature is further decreased.

The compositions and processes described herein enable formation of a cobalt filling having an electrical resistance that is competitive with copper. For example, depending on the thickness of a barrier layer necessary to prevent diffusion and electromigration of copper, a cavity having a width or diameter (entry dimension) less than 15 nm may be filled with cobalt over a seminal conductive layer of a given thickness on an interior wall of the cavity in such volume that the cobalt filling has an electrical resistance not more than 20% greater than a reference filling provided by electrodeposition of copper over a seminal conductive layer of the same given thickness on the interior wall of a reference cavity of the same entry dimension as the cobalt filled cavity, wherein a barrier layer against copper diffusion underlies the seminal conductive layer in the reference cavity. For example, the thickness of the barrier layer may be at least 30 angstroms. At entry dimensions significantly lower than 15 nm and/or reference barrier layer thicknesses greater than 30 angstroms, the electrical resistance of the cobalt filling can be significantly less than the electrical resistance of the reference copper filling. The utility of the cobalt filling as measured by its resistance relative to a copper filling becomes most pronounced in features having a width or diameter not greater than 10 nm, or not greater than 7 nm.

The advantages provide by filling submicron interconnects with cobalt rather than copper can be illustrated by reference to the schematic drawing. The narrow width of the via or trench is necessarily further narrowed by the need to provide a seminal conductive layer for electrodeposition of the metal that fills the interconnect feature. Where the feature is to be filled with copper, the available space within the feature is further diminished by the barrier layer indicated in the schematic, which is necessary to prevent diffusion of copper into the semiconductor substrate. However, where the feature is to be filled with cobalt, the barrier layer can be dispensed with, thereby materially increasing the volume available to be filled with metal.

A cobalt seed layer can typically be 0.5 to 40 nm thick, but for features having a width below 15 nm, it has been found feasible to provide a cobalt seed layer having a thickness of only about 2 nm at the side wall, about 4 nm at the bottom, and about 10 nm on the upper field surrounding the interconnect feature.

As discussed, a barrier layer can often be dispensed with where a submicron feature is to be filled with cobalt. Where a barrier layer is provided, it can be very thin, e.g., 0.1 to 40 nm, such as about 1 nm on the sidewall, about 4 nm at the bottom, and about 10 nm on the field, thus preserving a maximum volume for the cobalt fill.

FIG. 1 shows a cobalt fill and deposit into a submicron feature having the space between the cobalt fill and the dielectric occupied by the metal seed layer which provides the seminal conductive layer for electrodeposition, and the optional barrier layer. There are other preferred embodiments where there is no such barrier layer, as the barrier layer is essential where the feature is filled with copper, but not necessary where the feature is filled with cobalt in accordance with this invention.

A preferred product of the novel process comprises a semiconductor integrated circuit device comprising a semiconductor base structure having a plurality of cavities therein wherein each cavity of such plurality of cavities has an entry dimension of not greater than 15 nm and is filled with cobalt over a seminal conductive layer of a given thickness on the interior wall of the cavity, e.g., at least 20 angstroms. The electrical resistance of the cobalt filling is not more than 20% greater than a reference filling provided by electrodeposition of copper over a seminal conductive layer of the same given thickness located over a barrier layer on the interior wall of a reference cavity of the same entry dimension, the barrier layer typically having a thickness of at least 30 angstroms. Preferably, each cavity of the plurality of cavities has an entry dimension of not greater than 12 nm, not greater than 9 nm, not greater than 8 nm, not greater than 7 nm or not greater than 4 nm, or between about 5 nm and about 15 nm. The aspect ratio of the cavities of the plurality of cavities, is at least about 3:1, at least about 4:1, at least about 15:1, at least about 20:1 or at least about 30:1, typically between about 10:1 and about 50:1.

In preferred embodiments of the semiconductor integrated circuit device, the electrical resistance of the cobalt filling is equal to or less than the resistance of the reference copper filling.

Internal tensile stress in the cobalt filling is not greater than 500 MPa, typically between about 0 and about 500 MPa, or between 0 and about 400 MPa.

Although the compositions and processes described above have been found highly satisfactory for superfilling submicron features of semiconductor integrated circuit devices with cobalt, it has been found that additional benefits can in some instances be achieved by limiting the divalent sulfur content of the plating bath. Where divalent sulfur compounds are substantially excluded from the plating bath, the sulfur content of the cobalt deposit is lowered, with consequent beneficial effects on chemical mechanical polishing and circuit performance.

The composition may be considered "substantially free" of divalent sulfur compounds if it satisfies one or more of the following criteria: (i) submicron features of a semiconductor substrate are filled from the electrodeposition composition with a cobalt deposit that does not contain more than 300 ppm sulfur; or (ii) the concentration in the plating solution of accelerators comprising divalent sulfur is not greater than 1 mg/l. In this alternative embodiment, the concentration of compounds containing divalent sulfur atoms is not greater than 0.1 mg/l. Still more preferably, the concentration of compounds that contain divalent sulfur atoms is below the detection level using analytical techniques common to electronic product fabrication facilities.

In this alternative embodiment, it is further preferred that the electrodeposition composition is substantially free of compounds that contain sulfonic acid or sulfonate ion groups. The divalent sulfur-free compositions can contain saccharin as a stress reducer. Saccharin contributes only minimally, if at all, to the sulfur content of the cobalt deposit. It has been found that electrodeposition from compositions that contain no divalent sulfur compounds forms deposits that typically have a sulfur content no higher than about 300 ppm, typically 10 to 200 ppm, even where the electrodeposition composition comprises saccharin as a stress reducer.

It has been further surprisingly discovered not only that submicron features can be effectively superfilled using compositions that are devoid of accelerators that comprise divalent sulfur compounds, but that cobalt can be effectively deposited from a plating bath that contains no accelerator at all. Where the plating bath contains propargyl alcohol or another acetylenic suppressor such as those described above, the superfilling process proceeds satisfactorily without the need for an accelerator.

Preferably, the divalent sulfur-free electrodeposition composition contains between about 0.1 and about 5 wt. % cobalt ions, between about 5 and about 250 mg/l suppressor compound; and between about 1 and about 4.5 wt. % buffer. The pH of the composition is preferably between about 1.5 and about 7, preferably between about 2.5 and about 5.

In a further preferred embodiment, the composition comprises between about 5 and about 10 g/L cobaltous ion, between about 5 and about 30 mg/L of a suppressor selected from the group consisting of propargyl alcohol and ethoxylated propargyl alcohol, the balance essentially water. The pH of such composition is preferably between about 2.5 and about 3.5.

The composition is preferably substantially free of reducing agents, Ni ions and Fe ions. The limitations on these components as described above with respect to plating baths containing organic sulfur compound accelerators apply equally to the compositions that exclude divalent sulfur compounds.

The following examples illustrate the invention.

Example 1

An electrolytic cobalt deposition composition was prepared with the following components:

$CoSO_4$— 7.75 g/L (concentration with reference to anhydrous cobalt sulfate)

$H_3BO_3$— 31.92 g/L bis-(sodium sulfopropyl) disulfide (SPS)—10 mg/L propargyl alcohol—15 mg/L 968.8 g water to balance to 1 L pH adjusted to 2.9

This composition may be used to fill a feature having a 12 nm top opening, a 7 nm middle width, a 2 nm bottom width, and a depth of 130 nm at a current density of 4 mA/cm$^2$ for 3 minutes at room temperature and a rotation rate of 100 rpm.

When introducing elements of the present invention or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements.

As various changes could be made in the above without departing from the scope of the invention, it is intended that all matter contained in the above description and shown in the accompanying drawings shall be interpreted as illustrative and not in a limiting sense. The scope of invention is defined by the appended claims and modifications to the embodiments above may be made that do not depart from the scope of the invention.

The invention claimed is:

1. A process for electroplating a cobalt deposit onto a semiconductor base structure comprising submicron-sized electrical interconnect features, the process comprising the steps of:

a) contacting a metalizing substrate within said submicron sized electrical interconnect features with an electrodeposition composition comprising:

a source of cobalt ions;

an acetylenic suppressor, wherein said acetylenic suppressor is either a reaction product of ethoxylated propargyl alcohol and 1,4-butanediol diglycidyl ether or diethylene glycol bis (2-propynyl) ether;

a buffering agent; and water; and b) supplying electrical current to the electrodeposition composition to deposit cobalt onto the semiconductor base structure and fill the submicron-sized electrical interconnect features with cobalt;

wherein the electrodeposition composition is free of any further additive that would function as an accelerator.

2. A process as set forth in claim 1, wherein said electrodeposition composition further comprises an acid.

3. A process as set forth in claim 1, wherein said electrodeposition composition has a pH between about 1.5 and about 7 or between about 2.5 and about 5.

4. A process as set forth in claim 1, wherein said electrodeposition composition further comprises a stress reducer, wherein said stress reducer comprises saccharin.

5. A process as set forth in claim 1, wherein said electrodeposition composition is free of any functional concentration of reducing agents effective to reduce cobaltous ions ($Co^{2+}$) to metallic cobalt ($Co^0$).

6. A process as set forth in claim 5 wherein the molar ratio of any nickel ions to the cobalt ions and/or the molar ratio of any iron ions to cobalt ions and/or the molar ratio of the sum of nickel ions and iron ions in said composition is not greater than 0.01.

7. A process as set forth in claim 1, wherein said composition contains no more than about 0.001 vol. % solids.

8. A process as set forth in claim 1, wherein said composition is free of any functional concentration of solid particulates, or is free of any solid particulates that would be detectable by analytical apparatus or methods used in industrial fabrication of electronics products.

9. A process as set forth in claim 1, wherein said features comprise cavities in said semiconductor base structure that are superfilled by rapid bottom-up deposition of cobalt, and wherein said semiconductor base structure, including said submicron features, is immersed in said electrodeposition composition during supply of current to said composition.

10. A process as set forth in claim 9, wherein said submicron electrical interconnect features comprise a plurality of cavities in said semiconductor base structure, each cavity of said plurality having a bottom, sidewall, and top opening, and electrodeposition of cobalt fills the submicron features from the bottom up by rapid bottom-up deposition at a rate of growth in the vertical direction which is greater than a rate of growth in the horizontal direction.

11. A process as set forth in claim 1, wherein a metalizing substrate comprising a seminal conductive layer is formed on the internal surfaces of the submicron features, wherein the metalizing substrate is contacted with the electrodeposition composition and the electrical current is supplied to the electrodeposition composition to cause electrodeposition of cobalt on the metalizing substrate that fills the submicron features.

12. A process as set forth in claim 1, wherein the internal tensile stresses in cobalt filling said features is not greater than 500 MPa.

13. A process as set forth in claim 1, wherein the entry dimension of the submicron interconnect is less than 100 nm, or less than 50 nm, or less than 30 nm, or less than 20 nm, or less than 10 nm, or between 5 and 15 nm.

14. A process as set forth in claim 1, wherein said submicron interconnects have an aspect ratio of greater than 3:1 or greater than 4:1 or between 4:1 and 10:1.

15. A process as set forth in claim 1, wherein said submicron interconnects have an aspect ratio of greater than 15:1, or greater than 20:1, or greater than 30:1 or between 10:1 and 50:1.

16. A process according to claim 1, wherein said electrodeposition composition is substantially free of any divalent sulfur compounds, and free of any functional concentration of reducing agents effective to reduce cobaltous ions ($Co^{2+}$) to metallic cobalt ($Co^{0}$).

17. A process as set forth in claim 1, wherein the electrodeposition composition comprises 5 to 10 g/L of cobalt ions.

18. A process as set forth in claim 1, wherein the electrodeposition composition comprises 10 to 50 mg/L of the acetylenic suppressor.

19. A process as set forth in claim 1, wherein the acetylenic suppressor comprises a reaction product of ethoxylated propargyl alcohol and 1,4-butanediol diglycidyl ether.

20. A process as set forth in claim 1, wherein the acetylenic suppressor comprises diethylene glycol bis(2-propynyl) ether.

* * * * *